US009291947B1

(12) United States Patent
Bacelieri et al.

(10) Patent No.: US 9,291,947 B1
(45) Date of Patent: Mar. 22, 2016

(54) SEALING RIBS FOR A DEVELOPER UNIT OF A DUAL COMPONENT DEVELOPMENT ELECTROPHOTOGRAPHIC IMAGE FORMING DEVICE

(71) Applicant: Lexmark International, Inc., Lexington, KY (US)

(72) Inventors: Michael Brian Bacelieri, Lexington, KY (US); Robert Dan Bennett, III, Paris, KY (US); Gary Allen Denton, Lexington, KY (US); Mark Doerre, Lexington, KY (US); Katherine Marie Gilliam, Lexington, KY (US); Elliott Vincent Jernigan, Lexington, KY (US); Michael David Maul, Lexington, KY (US); Matthew Lee Rogers, Lexington, KY (US); Dominique Renee Rowe, Lexington, KY (US); Robert Christopher Sbert, Winchester, KY (US); Keith Seaman, Lexington, KY (US); Courtney Harrison Soale, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/683,383

(22) Filed: Apr. 10, 2015

(51) Int. Cl.
*G03G 15/08* (2006.01)
*G03G 15/09* (2006.01)

(52) U.S. Cl.
CPC ..... *G03G 15/0942* (2013.01); *G03G 15/0928* (2013.01)

(58) Field of Classification Search
USPC ..... 399/91, 98, 102–107, 111, 119, 120, 399/252–254, 258, 259, 265–267, 276, 277, 399/279, 281, 282
See application file for complete search history.

(56) References Cited

U.S. PATENT DOCUMENTS 5,506,665 A * 4/1996 Ishida ..... G03G 15/0877 141/364
2002/0172526 A1* 11/2002 Miyabe ..... G03G 15/0942 399/104
2015/0016829 A1* 1/2015 Watanabe ..... B29C 45/14008 399/27

OTHER PUBLICATIONS

Page 3-36 from Xerox Docucentre-IV C5570/C4470/C3370/C2270 Service Manual dated 2009-2010 (magnetic roll is labeled "DEVE" and photoconductive drum is labeled "CPC").

* cited by examiner

*Primary Examiner* — Hoan Tran
(74) *Attorney, Agent, or Firm* — Justin M Tromp

(57) ABSTRACT

A developer unit for a dual component development electrophotographic image forming device includes a housing having a reservoir for storing a developer mix that includes toner and magnetic carrier beads. An axial sealing rib projects from an inner side of the housing toward the outer surface of a sleeve of a magnetic roll. The axial sealing rib extends along an axial length of the sleeve. A distal end of the axial sealing rib is positioned in close proximity to and spaced from the outer surface of the sleeve. The axial sealing rib is positioned to impede the flow of developer mix in the reservoir in a direction counter to an operative rotational direction of the sleeve.

19 Claims, 7 Drawing Sheets

SEALING RIBS FOR A DEVELOPER UNIT OF A DUAL COMPONENT DEVELOPMENT ELECTROPHOTOGRAPHIC IMAGE FORMING DEVICE

CROSS REFERENCES TO RELATED APPLICATIONS

None.

BACKGROUND

1. Field of the Disclosure

The present disclosure relates generally to image forming devices and more particularly to sealing ribs for a developer unit of a dual component development electrophotographic image forming device.

2. Description of the Related Art

Dual component development electrophotographic image forming devices include one or more reservoirs that store a mixture of toner and magnetic carrier beads (the "developer mix"). Toner is electrostatically attracted to the carrier beads as a result of triboelectric interaction between the toner and the carrier beads. A magnetic roll includes a stationary core having one or more permanent magnets and a sleeve that rotates around the core. The magnetic roll attracts the carrier beads in the reservoir having toner thereon to the outer surface of the sleeve through the use of magnetic fields from the core. The developer mix forms chains that extend from the outer surface of the sleeve along the magnetic field lines of the permanent magnet(s). A photoconductive drum in close proximity to the sleeve of the magnetic roll is charged by a charge roll to a predetermined voltage and a laser selectively discharges areas on the surface of the photoconductive drum to form a latent image on the surface of the photoconductive drum. The sleeve is electrically biased to facilitate the transfer of toner from the chains of developer mix on the outer surface of the sleeve to the discharged areas on the surface of the photoconductive drum forming a toner image on the surface of the photoconductive drum. The photoconductive drum then transfers the toner image, directly or indirectly, to a media sheet forming a printed image on the media sheet.

The outer surface of the sleeve of the magnetic roll is spaced from an inner surface of a housing that supports the magnetic roll so that the housing does not interfere with the transport of the chains of developer mix by the rotating sleeve. However, if the housing is dropped during shipping or handling, developer mix may tend to leak out of the housing through gaps between the sleeve and the housing. Accordingly, sealing of gaps between the sleeve and the housing is desired.

SUMMARY

A developer unit for a dual component development electrophotographic image forming device according to one example embodiment includes a housing having a reservoir for storing a developer mix that includes toner and magnetic carrier beads. A magnetic roll includes a stationary core and a sleeve positioned around the core. The sleeve is rotatable relative to the core about an axis of rotation. The core includes at least one permanent magnet having a plurality of circumferentially spaced magnetic poles. An outer surface of the sleeve is positioned to carry developer mix attracted from the reservoir to the outer surface of the sleeve by the at least one permanent magnet in an operative rotational direction of the sleeve. A first axial sealing rib projects from an inner side of the housing toward the outer surface of the sleeve. The first axial sealing rib extends along an axial length of the sleeve. A distal end of the first axial sealing rib is positioned in close proximity to and spaced from the outer surface of the sleeve. The first axial sealing rib is positioned to impede the flow of developer mix in the reservoir in a direction counter to the operative rotational direction. The first axial sealing rib is positioned at a point between two of the plurality of circumferentially spaced magnetic poles where magnetic field lines of the plurality of circumferentially spaced magnetic poles have a primarily tangential orientation relative to the outer surface of the sleeve.

A developer unit for a dual component development electrophotographic image forming device according to another example embodiment includes a housing having a reservoir for storing a developer mix that includes toner and magnetic carrier beads. A magnetic roll includes a stationary core and a sleeve positioned around the core. The sleeve is rotatable relative to the core about an axis of rotation. The core includes at least one permanent magnet having a plurality of circumferentially spaced magnetic poles. The plurality of circumferentially spaced magnetic poles includes a pickup pole that is positioned to magnetically attract developer mix from the reservoir to the outer surface of the sleeve for carrying by the sleeve as the sleeve rotates in an operative rotational direction. The outer surface of the sleeve is positioned to carry the developer mix from the reservoir through a portion of the magnetic roll that is exposed from the reservoir to permit transfer of toner from the outer surface of the sleeve to a photoconductive drum and back to the reservoir as the sleeve rotates in the operative rotational direction. A first axial sealing rib and a second axial sealing rib each project from an inner side of the housing toward the outer surface of the sleeve. The first axial sealing rib and the second axial sealing rib extend along an axial length of the sleeve. Distal ends of the first axial sealing rib and the second axial sealing rib are positioned in close proximity to and spaced from the outer surface of the sleeve. The second axial sealing rib is spaced circumferentially relative to the sleeve from the first axial sealing rib. Downstream faces of the first axial sealing rib and the second axial sealing rib relative to the operative rotational direction are angled toward the outer surface of the sleeve to direct developer mix traveling counter to the operative rotational direction toward the outer surface of the sleeve. The first axial sealing rib and the second axial sealing rib are positioned upstream from the pickup pole and downstream from the portion of the magnetic roll that is exposed from the reservoir relative to the operative rotational direction.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
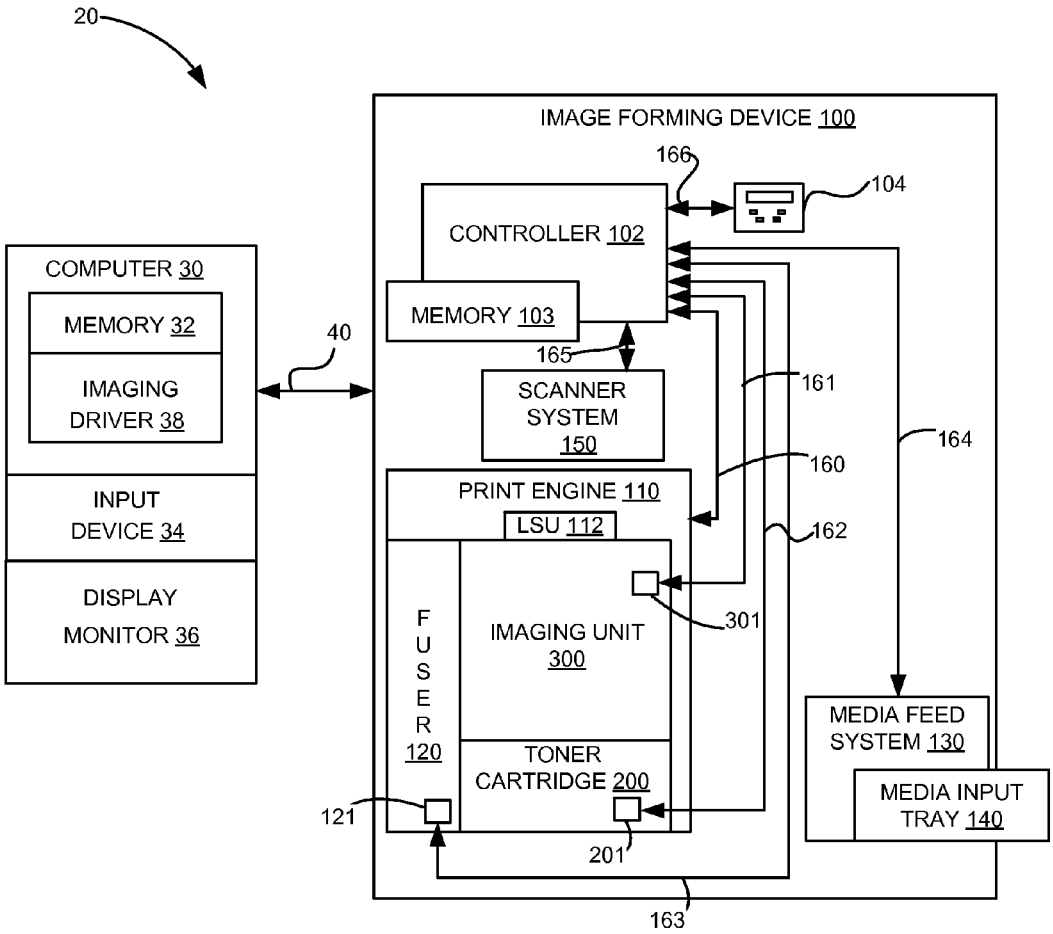
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103. The processor may include one or more integrated circuits in the form of a microprocessor or central processing unit and may be formed as one or more Application Specific Integrated Circuits (ASICs). Memory 103 may be any volatile or non-volatile memory or combination thereof, such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory, such as RAM, ROM, and/or NVRAM, and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer, such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
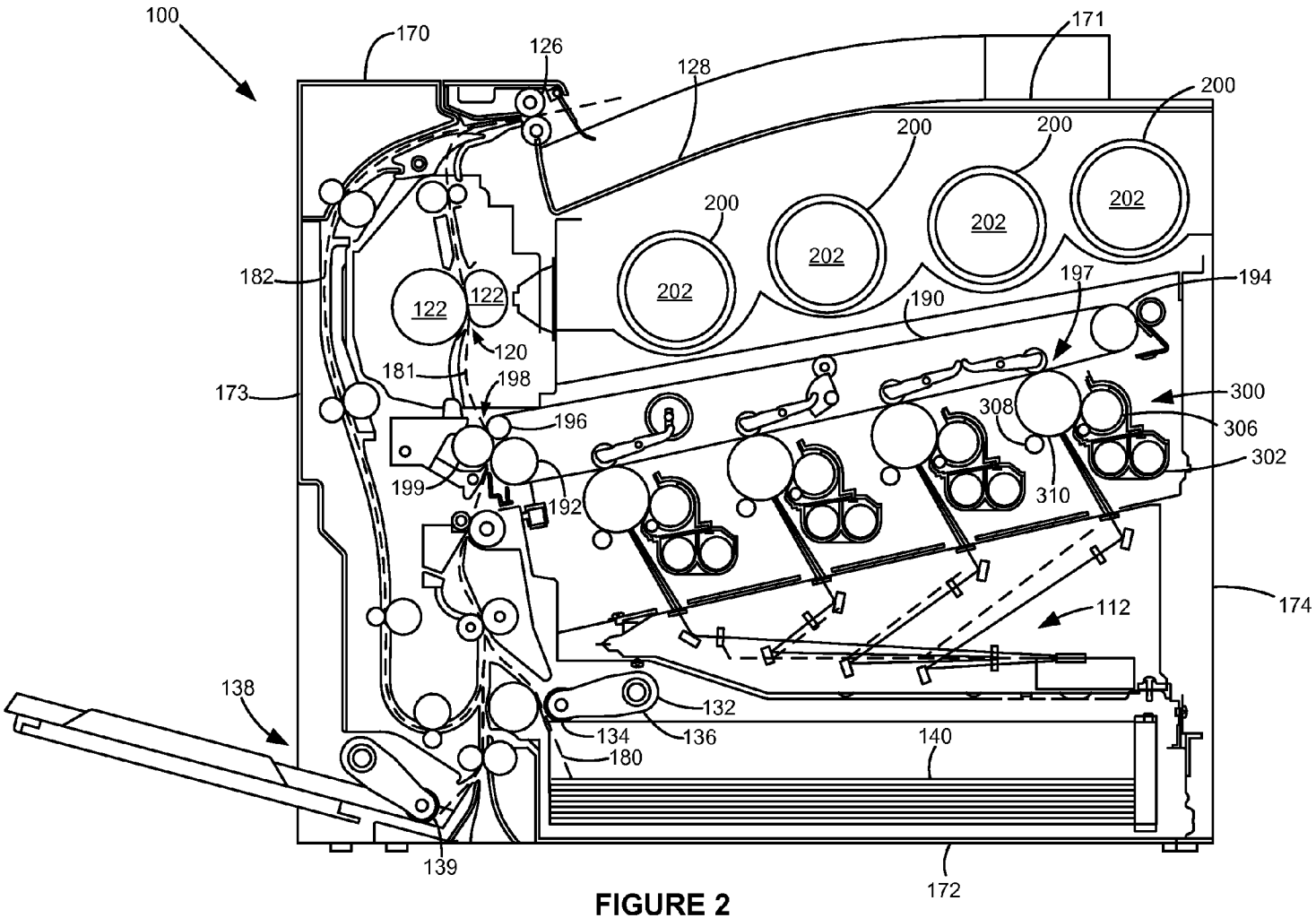
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which may also be removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner.

Image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Each imaging unit 300 also includes a charge roll 308 and a photoconductive (PC) drum 310 and a cleaner blade or roll (not shown) that collectively form a PC unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Magnetic roll 306 attracts the carrier beads in reservoir 302 having toner thereon to magnetic roll 306 through the use of magnetic fields and transports the toner to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a color image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art. In addition, toner may be transferred directly from each toner cartridge 200 to its corresponding imaging unit 300 or the toner may pass through an intermediate component, such as a chute, duct or hopper, that connects the toner cartridge 200 with its corresponding imaging unit 300.

Imaging unit(s) 300 may be replaceable in any combination desired. For example, in one embodiment, the developer unit and PC unit are provided in separate replaceable units from each other. In another embodiment, the developer unit and PC unit are provided in a common replaceable unit. In another embodiment, toner reservoir 202 is provided with the developer unit instead of in a separate toner cartridge 200. For a color image forming device 100, the developer unit and PC unit of each color toner may be separately replaceable or the developer unit and/or the PC unit of all colors (or a subset of all colors) may be replaceable collectively as desired.

Figure 3:
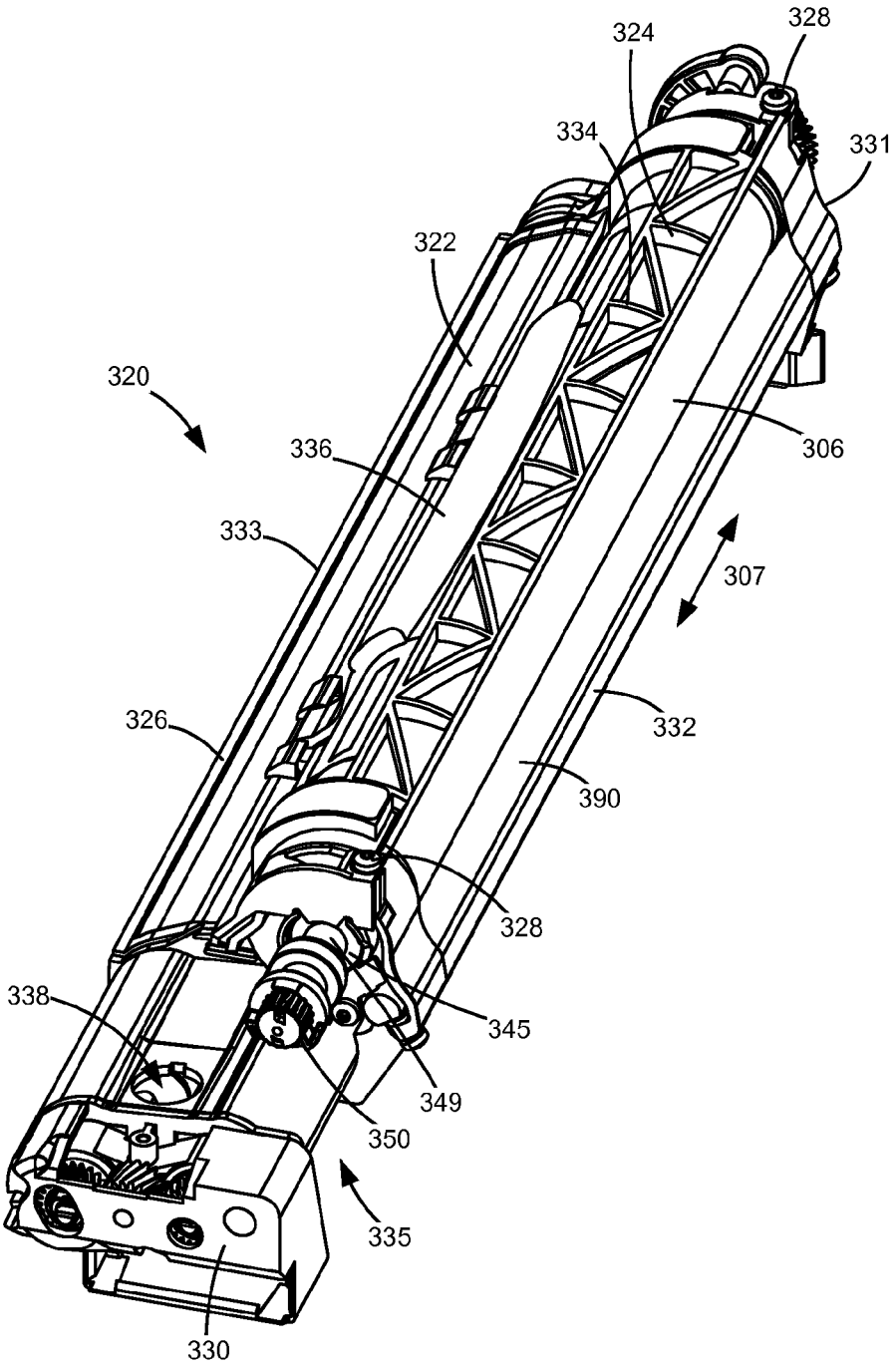
FIG. 3 is a perspective view of a developer unit according to one example embodiment.
Figure 4:
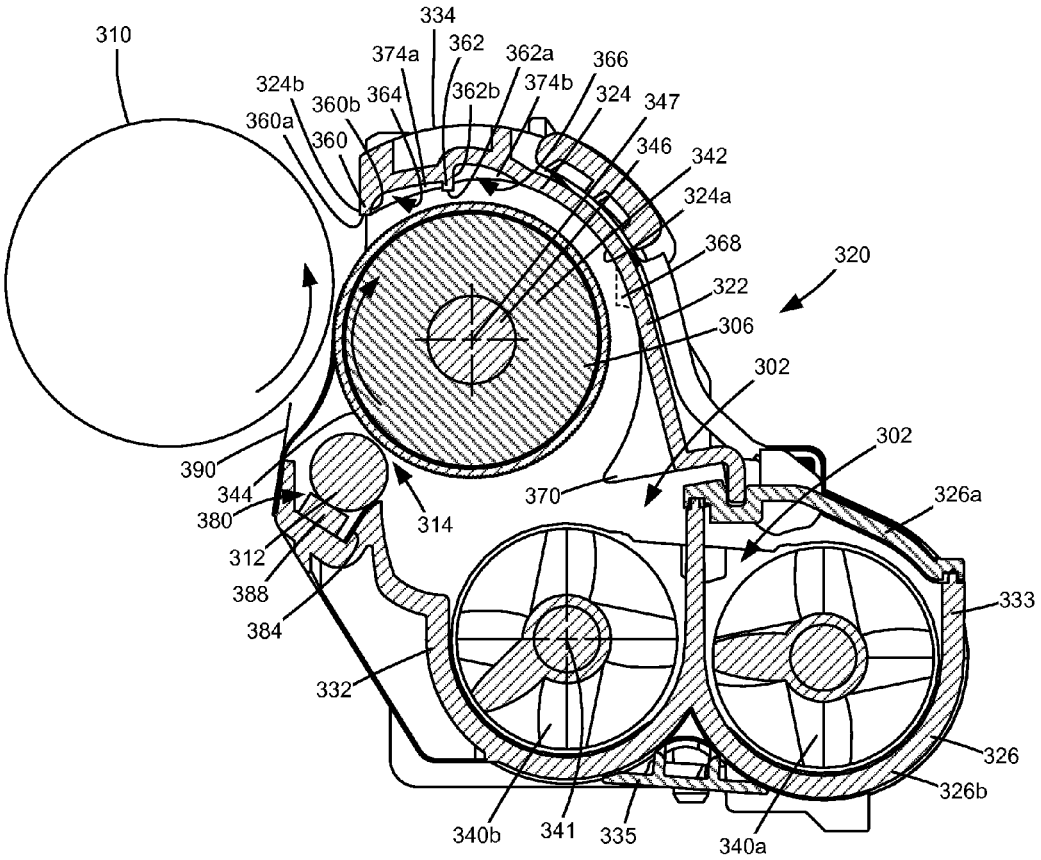
FIG. 4 is a cross-sectional view of the developer unit shown in FIG. 3.

FIGS. 3 and 4 show a developer unit 320 according to one example embodiment. Developer unit 320 includes a housing 322 having reservoir 302 therein. In some embodiments, housing 322 includes a lid 324 mounted on a base 326. Lid 324 may be attached to base 326 by any suitable construction including, for example, by fasteners (e.g., screws 328), adhesive and/or welding. Alternatively, lid 324 may be formed integrally with base 326. In the example embodiment illustrated, base 326 includes a top portion **326*a* attached (e.g., by fasteners, adhesive and/or welding) to a lower portion 326*b*. Alternatively, top portion 326*a* of base 326 may be formed integrally with lower portion 326*b* of base 326. Housing 322 extends generally along an axial direction 307 of magnetic roll 306 from a first side 330 of housing 322 to a second side 331 of housing 322. Side 330 leads during insertion of developer unit 320 into image forming device 100. A portion of magnetic roll 306 is exposed from reservoir 302 at a front 332 of housing 322. A handle 336 is optionally positioned on a rear 333 of housing 322 to assist with separating developer unit 320 from the corresponding PC unit. Housing 322 also includes a top 334 and a bottom 335**.

Reservoir 302 holds the mixture of toner and magnetic carrier beads (the "developer mix"). Developer unit 320 includes an inlet port 338 in fluid communication with reservoir 302 and positioned to receive toner from toner cartridge 200 to replenish reservoir 302 when the toner concentration in reservoir 302 relative to the amount of carrier beads remaining in reservoir 302 gets too low as toner is consumed from reservoir 302 by the printing process. In the example embodiment illustrated, inlet port 338 is positioned on top 334 of housing 322 near side 330; however, inlet port 338 may be positioned at any suitable location on housing 322.

Reservoir 302 includes one or more agitators to stir and move the developer mix. For example, in the embodiment illustrated, reservoir 302 includes a pair of augers 340*a*, 340*b*. Augers 340*a*, 340*b* are arranged to move the developer mix in opposite directions along the axial length of magnetic roll 306. For example, auger 340*a* is positioned to incorporate toner from inlet port 338 and to move the developer mix away from side 330 and toward side 331. Auger 340*b* is positioned to move the developer mix away from side 331, toward side 330 and in proximity to the bottom of magnetic roll 306. This arrangement of augers 340*a*, 340*b* is sometimes informally referred to as a racetrack arrangement because of the circular path the developer mix in reservoir 302 takes when augers 340*a*, 340*b* rotate.

With reference to FIG. 4, magnetic roll 306 includes a core 342 that includes one or more permanent magnets and that does not rotate relative to housing 322. A cylindrical sleeve 344 encircles core 342 and extends along the axial length of magnetic roll 306. A shaft 346 passes through the center of core 342 and defines an axis of rotation 347 of magnetic roll 306. Shaft 346 is fixed, i.e., shaft 346 does not rotate with sleeve 344 relative to housing 322, and controls the position of core 342 relative to sleeve 344 and to the other components of developer unit 320. With reference back to FIG. 3, a rotatable end cap 345 is positioned at one axial end of magnetic roll 306, referred to as the drive side of magnetic roll 306. End cap 345 is coupled to sleeve 344 such that rotation of end cap 345 causes sleeve 344 to rotate around core 342. Sleeve 344 rotates in a clockwise direction as viewed in FIG. 4 to transport the developer mix from reservoir 302 to PC drum 310. A drive coupler 350 is operatively connected to end cap 345 either directly, such as on an end of a shaft 349 that extends axially outward from end cap 345 as shown in the example embodiment illustrated, or indirectly. Drive coupler 350 is positioned to receive rotational force from a corresponding drive coupler in image forming device 100 when developer unit 320 is installed in image forming device 100. Any suitable drive coupler 350 may be used as desired, such as a toothed gear or a drive coupler that receives rotational force at its axial end. In one embodiment, augers 340*a*, 340*b* are operatively connected to drive coupler 350 by one or more intermediate gears (not shown). Alternatively, augers 340*a*, 340*b* may be driven independently of drive coupler 350 and sleeve 344 by a second drive coupler positioned to receive rotational force from a corresponding drive coupler in image forming device 100 when developer unit 320 is installed in image forming device 100.

Figure 5:
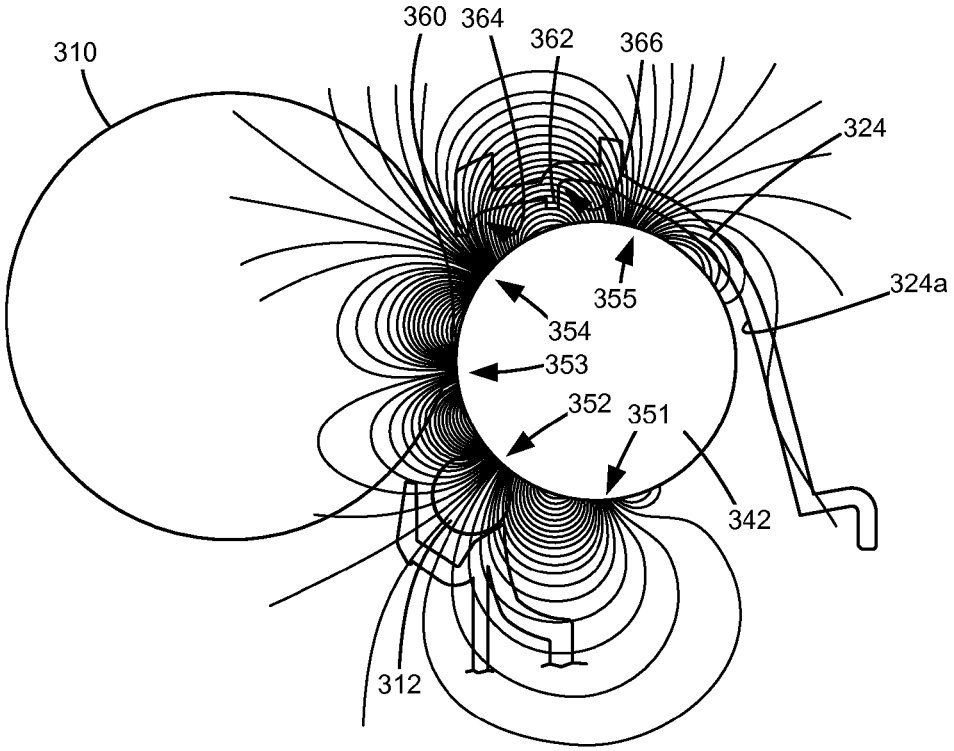
FIG. 5 is a schematic diagram of the developer unit of FIGS. 3 and 4 showing the magnetic field lines of a magnetic roll according to one example embodiment.

With reference to FIGS. 4 and 5, the permanent magnet(s) of core 342 include a series of circumferentially spaced, alternating (south v. north) magnetic poles that facilitate the transport of developer mix to PC drum 310 as sleeve 344 rotates. FIG. 5 shows the magnetic field lines generated by the magnetic poles of core 342 according to one example embodiment. Core 342 includes a pickup pole 351 positioned near the bottom of core 342 (near the 6 o'clock position of core 342 as viewed in FIG. 5). Pickup pole 351 magnetically attracts developer mix in reservoir 302 to the outer surface of sleeve 344. The magnetic attraction from core 342 causes the developer mix to form cone or bristle-like chains that extend from the outer surface of sleeve 344 along the magnetic field lines.

After the developer mix is picked up at pickup pole 351, as sleeve 344 rotates, the developer mix on sleeve 344 advances toward a trim bar 312. Trim bar 312 is positioned in close proximity to the outer surface of sleeve 344. Trim bar 312 trims the chains of developer mix as they pass to a predetermined average height defined by a trim bar gap 314 formed between trim bar 312 and the outer surface of sleeve 344 in order to control the mass of developer mix on the outer surface of sleeve 344. Trim bar gap 314 dictates how much developer mix is allowed to pass on the outer surface of sleeve 344 from reservoir 302 toward PC drum 310. Trim bar 312 may be magnetic or non-magnetic and may take a variety of different shapes including having a flat or rounded trimming surface. Trim bar 312 may be electrically biased to aid in trimming the chains of developer mix. Core 342 includes a trim pole 352 positioned at trim bar 312 to stand the chains of developer mix up on sleeve 344 in a generally radial orientation for trimming by trim bar 312. As shown in FIG. 5, between pickup pole 351 and trim pole 352, the chains of developer mix on sleeve 344 have a primarily tangential (as opposed to radial) orientation relative to the outer surface of sleeve 344 according to the magnetic field lines between pickup pole 351 and trim pole 352.

As sleeve 344 rotates further, the developer mix on sleeve 344 passes in close proximity to the outer surface of PC drum 310. As discussed above, electrostatic forces from the latent image formed on PC drum 310 by the laser beam from LSU 112 strip the toner from the carrier beads to form a toned image on the surface of PC drum 310. Core 342 includes a developer pole 353 positioned at the point where the outer surface of sleeve 344 passes in close proximity to the outer surface of PC drum 310 to once again stand the chains of developer mix up on sleeve 344 in a generally radial orientation to promote the transfer of toner from sleeve 344 to PC drum 310. The developer mix is less dense and less coarse when the chains of developer mix are stood up in a generally radial orientation than it is when the chains are more tangential. As a result, less wear occurs on the surface of PC drum 310 from contact between PC drum 310 and the chains of developer mix when the chains of developer mix on sleeve 344 are in a generally radial orientation.

As sleeve 344 continues to rotate, the remaining developer mix on sleeve 344, including the toner not transferred to PC drum 310 and the carrier beads, is carried by magnetic roll 306 past PC drum 310 and back toward reservoir 302. Core 342 includes a transport pole 354 positioned past the point where the outer surface of sleeve 344 passes in close proximity to the outer surface of PC drum 310. Transport pole 354 magnetically attracts the remaining developer mix to sleeve 344 to prevent the remaining developer mix from migrating to PC drum 310 or otherwise releasing from sleeve 344. As sleeve 344 rotates further, the remaining developer mix passes under lid 324 and is carried back to reservoir 302 by magnetic roll 306. Core 342 includes a release pole 355 positioned near the top of core 342 along the direction of rotation of sleeve 344. Release pole 355 magnetically attracts the remaining developer mix to sleeve 344 as the developer mix is carried the remaining distance to the point where it is released back into reservoir 302. As the remaining developer mix passes the 2 o'clock position of core 342 as viewed in FIG. 5, the developer mix is no longer magnetically retained against sleeve 344 by core 342 allowing the developer mix to fall via gravity and centrifugal force back into reservoir 302.

Figure 6:
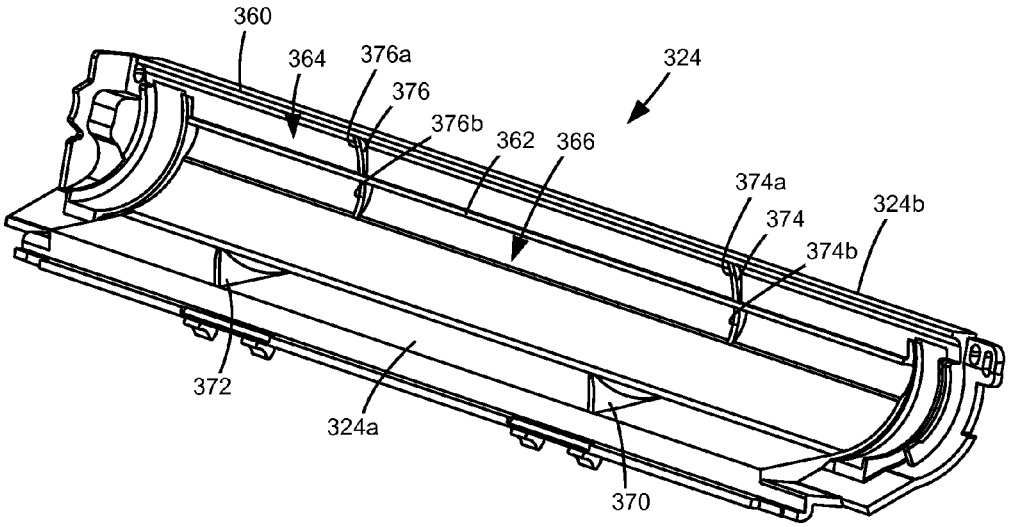
FIG. 6 is a perspective view of an inner side of a lid of the developer unit shown in FIGS. 3-5 according to one example embodiment.

FIG. 6 shows an inner side 324*a* of lid 324, i.e., the side of lid 324 positioned proximate to magnetic roll 306, according to one example embodiment. In one embodiment, housing 322 includes one or more ribs that project from inner side 324*a* of lid 324 toward the outer surface of sleeve 344 and that extend along the axial length of magnetic roll 306. The rib(s) aid in preventing developer mix from leaking through the gap between lid 324 and the outer surface of sleeve 344 if developer unit 320 is dropped during shipping or handling as discussed in greater detail below. With reference to FIGS. 4-6, in the embodiment illustrated, housing 320 includes ribs 360, 362 that project in a cantilevered manner from inner side 324*a* of lid 324 toward sleeve 344. Free or distal ends 360*a*, 362*a* of ribs 360, 362 extend to within close proximity of the outer surface of sleeve 344. Distal ends 360*a*, 362*a* are spaced just far enough from the outer surface of sleeve 344 so as not to interfere with the chains of developer mix on the outer surface of sleeve 344. In some embodiments, ribs 360, 362 extend along the axial length of magnetic roll 306 across at least a majority of the axial length of magnetic roll 306 and, in the example embodiment illustrated, across substantially the entire axial length of core 342. Ribs 360, 362 are spaced circumferentially from each other with respect to sleeve 344.

Rib 360 is positioned at a front edge 324*b* of lid 324 where developer mix that remains on sleeve 344 after passing PC drum 310 travels under lid 324 and reenters reservoir 302. In one embodiment, rib 360 projects toward sleeve 344 at the location of transport pole 354 as shown in FIG. 5. Rib 362 is spaced downstream from rib 360 relative to the operative rotational direction of sleeve 344. As shown in FIG. 5, in one embodiment, rib 362 is positioned at a point between transport pole 354 and release pole 355 where the magnetic field lines and, in turn, the chains of developer mix on sleeve 344 have a primarily tangential orientation relative to the outer surface of sleeve 344. By positioning rib 362 where the magnetic field lines are primarily tangential relative to the outer surface of sleeve 344, rib 362 is able to extend closer to the outer surface of sleeve 344 without interfering with the developer mix on the outer surface of sleeve 344 because the chains of developer mix do not extend as far from the outer surface of sleeve 344 in this region. In one example embodiment, rib 360 extends to within between 2.1 mm and 2.8 mm of the outer surface of sleeve 344 measured radially with respect to axis of rotation 347 of magnetic roll 306. In one example embodiment, rib 362 extends to within between 0.9 mm and 1.6 mm of the outer surface of sleeve 344 measured radially with respect to axis of rotation 347 of magnetic roll 306.

In one embodiment, each rib 360, 362 includes a pocket 364, 366 formed in inner side 324*a* of lid 324 and positioned immediately downstream from the respective rib 360, 362 relative to the operative rotational direction of sleeve 344. A downstream face 360*b*, 362*b* of each rib 360, 362 relative to the operative rotational direction of sleeve 344 defines an upstream end of each pocket 364, 366. Downstream faces 360*b*, 362*b* are angled toward the outer surface of sleeve 344 and may be planar (like example face 362*b* shown in FIG. 4) or concave to the outer surface of sleeve 344 (like example face 360*b* shown in FIG. 4). Each pocket 364, 366 is defined by a surface of inner side 324*a* of lid 324 that is concave to the outer surface of sleeve 344. The surface of inner side 324*a* of lid 324 defining the pocket 364, 366 has a radius of curvature that increases as the surface approaches the downstream face 360*b*, 362*b* of the corresponding rib 360, 362.

If developer unit 320 is dropped during shipping or handling, developer mix from reservoir 302 may tend to travel up and around the rear side of magnetic roll 306 in the gap between the outer surface of sleeve 344 and inner side 324*a* of lid 324 toward front edge 324*b* of lid 324, i.e., counterclockwise along the outer surface of sleeve 344 as viewed in FIG. 4. If this occurs, ribs 360, 362 tend to impede the flow of developer mix toward front edge 324*b* of lid 324 and reduce the amount of developer mix that leaks from the front 332 of housing 322 between inner side 324*a* of lid 324 and the outer surface of sleeve 344. The strength of the magnetic field of the permanent magnet(s) of core 342 increases significantly closer to the outer surface of sleeve 344. The curvature of pockets 364, 366 and the angle of downstream faces 360*b*, 362*b* of ribs 360, 362 toward the outer surface of sleeve 344 tend to redirect developer mix traveling counter to the operative rotational direction of sleeve 344 toward the outer surface of sleeve 344 where it is more strongly attracted to and, as a result, more likely to be retained against the outer surface of sleeve 344 further reducing the amount of developer mix that leaks from the front 332 of housing 322.

While the example embodiment illustrated shows two ribs 360, 362, it will be appreciated that inner side 324*a* of lid 324 may instead include one or more than two axially extending ribs as desired. Inner side 324*a* of lid 324 may include one or more ribs in locations different from those of ribs 360, 362, either in place of or in addition to ribs 360 and/or 362. For example, FIG. 4 shows an optional rib 368 in dashed lines positioned between release pole 355 and pickup pole 351. Like ribs 360, 362, rib 368 impedes the flow of developer mix counter to the operative rotational direction of sleeve 344 if developer unit 320 is dropped.

With reference to FIG. 6, in some embodiments, housing 322 also includes one or more ribs that project in a cantilevered manner from inner side 324*a* of lid 324 toward the outer surface of sleeve 344 and that extend circumferentially along a portion of the outer surface of sleeve 344. The rib(s) aid in impeding the axial flow of developer mix relative to magnetic roll 306 if developer unit 320 is dropped. In the example embodiment illustrated, inner side 324*a* of lid 324 includes a pair of ribs 370, 372 that project from inner side 324*a* of lid 324 toward the outer surface of sleeve 344 and are spaced from the outer surface of sleeve 344. Ribs 370, 372 are spaced axially from each other relative to magnetic roll 306 and extend circumferentially along a portion of the outer circumference of sleeve 344. As shown in FIG. 4, rib 370 and rib 372, which is obscured in FIG. 4 by rib 370, extend around a portion of a bottom-rear quadrant of the outer surface of sleeve 344 formed between the 3 o'clock and 6 o'clock positions of sleeve 344 as viewed in FIG. 4. In other embodiments, inner side 324*a* of lid 324 includes one or more than two ribs similar to ribs 370, 372 that are axially spaced from each other and that extend around a portion of a bottom-rear quadrant of the outer surface of sleeve 344.

As shown in FIG. 6, in one embodiment, inner side 324*a* of lid 324 includes a pair of ribs 374, 376 that project from inner side 324*a* of lid 324 toward the outer surface of sleeve 344 and are spaced from the outer surface of sleeve 344. Ribs 374, 376 are spaced axially from each other relative to magnetic roll 306 and extend circumferentially along a portion of the outer surface of sleeve 344 proximate to ribs 360, 362. In the example embodiment illustrated, each rib 374, 376 includes a first portion 374*a*, 376*a* that extends circumferentially from rib 360 to rib 362 and a second portion 374*b*, 376*b* that extends circumferentially from rib 362 along the operative rotational direction of sleeve 344 toward roughly the 1 o'clock position of sleeve 344 as viewed in FIG. 4. In other embodiments, inner side 324*a* of lid 324 includes one or more than two ribs similar to ribs 374, 376 that are axially spaced from each other and that extend circumferentially along a portion of the outer surface of sleeve 344 proximate to ribs 360, 362.

If developer unit 320 is dropped during shipping or handling, particularly if developer unit 320 is dropped with side 330 or side 331 facing down, ribs 370, 372, 374, 376 tend to impede the flow of developer mix axially relative to magnetic roll 306. In this manner, ribs 370, 372, 374, 376 aid in preventing a large mass of developer mix from traveling from one axial end of reservoir 302 to the other, which may cause leakage of developer mix from housing 322 at the axial ends of magnetic roll 306. In some embodiments, housing 322 also includes a magnetic shunt and/or a magnetic seal at each axial end of magnetic roll 306 that further reduce leakage of developer mix from housing 322 at the axial ends of magnetic roll 306 if developer unit 320 is dropped. The magnetic shunts are composed of a magnetically permeable material that pulls or redirects the magnetic field lines from the axial ends of core 342 back into core 342 to decrease the distance that the magnetic field lines extend axially past core 342. During operation, the magnetic field lines redirected by the shunts at the axial ends of magnetic roll 306 cause a wall of developer mix to accumulate at the axial ends of magnetic roll 306 forming a barrier to reduce the developer mix leaking at the axial ends of magnetic roll 306 if developer unit 320 is dropped. The magnetic seals each include a permanent magnet positioned in close proximity to a portion of the outer surface of sleeve 344 at each axial end of magnetic roll 306 that attracts any developer mix that leaks axially outward of magnetic roll 306. Housing 322 may also include a seal (e.g., a foam or polymeric seal) in contact with the outer surface of sleeve 344 at each axial end of magnetic roll 306, axially outboard of the portion of sleeve 344 where developer mix chains form due to magnetic attraction to core 342, to further inhibit leakage of developer mix from housing 322 at the axial ends of magnetic roll 306 if developer unit 320 is dropped.

The use of axially spaced, circumferentially extending ribs such as ribs 370, 372, 374, 376 is not limited to the example embodiment illustrated. For example, inner side 324*a* of lid 324 may include ribs 370 and 372 but not ribs 374 and 376 or vice versa. Further, inner side 324*a* of lid 324 may include one or more axially spaced, circumferentially extending ribs in locations different from those of ribs 370, 372, 374, 376, either in place of or in addition to one or more of ribs 370, 372, 374, 376.

Figure 7:
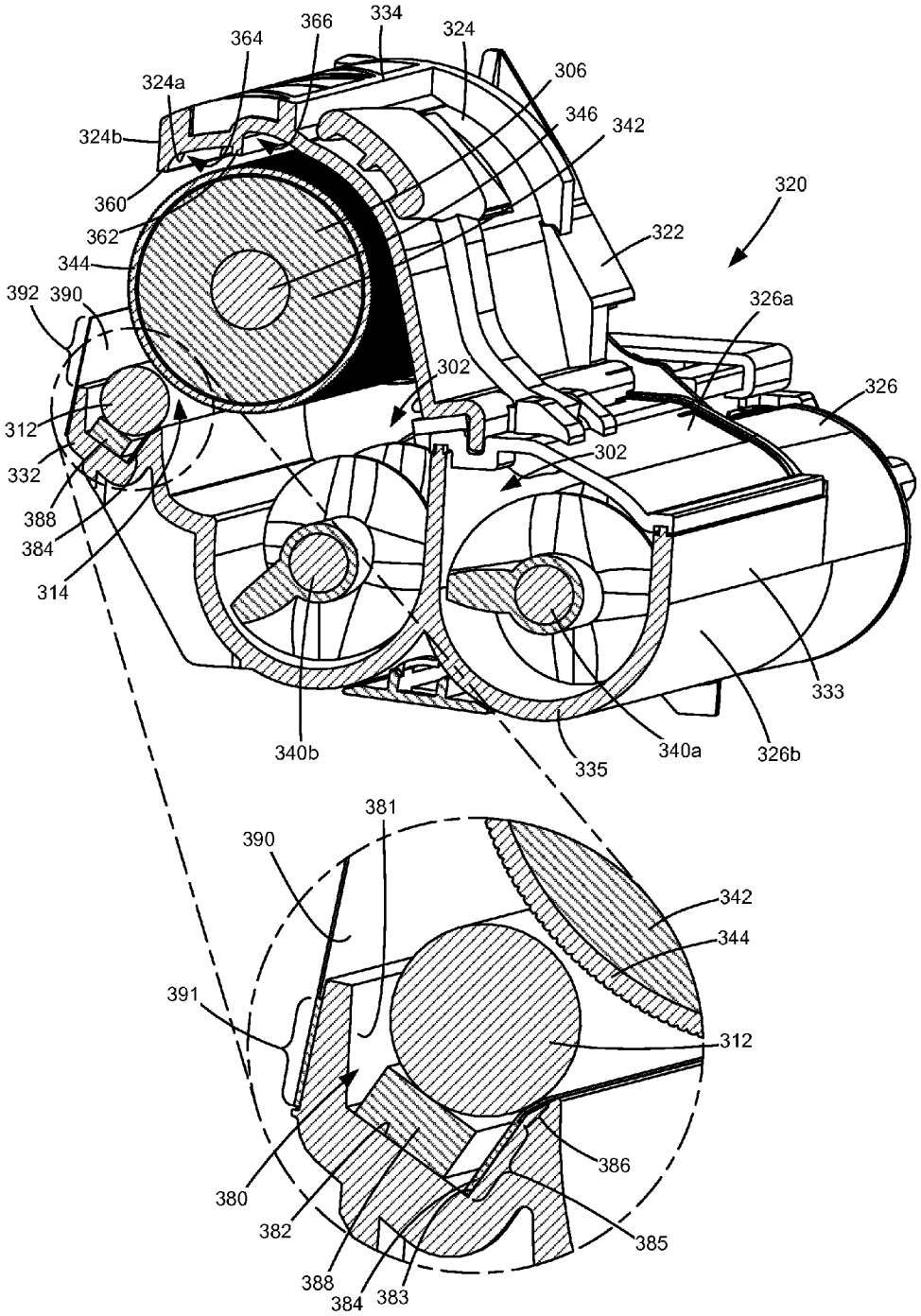
FIG. 7 is a cross-sectional perspective view of the developer unit shown in FIGS. 3-6.

With reference to FIGS. 4 and 7, trim bar 312 is mounted in a channel 380 that runs axially along the front 332 of housing 322 and faces a bottom, front portion of magnetic roll 306. Channel 380 includes a front surface 381, a bottom surface 382 and a rear surface 383. In some embodiments, a seal 384 is positioned against rear surface 383 of channel 380. Seal 384 is formed from a flexible material such as a polyethylene terephthalate (PET) material, e.g., MYLAR® available from DuPont Teijin Films, Chester, Va., USA. A lower segment 385 of seal 384 is adhered to rear surface 383 along the length of channel 380. An upper segment 386 of seal 384 extends in a cantilevered manner from a top portion of rear surface 383. Upper segment 386 of seal 384 is positioned against and defected rearward by a rear side of trim bar 312. If developer unit 320 is dropped during shipping or handling, developer mix from reservoir 302 may tend to leak from the front 332 of housing 322 from between trim bar 312 and housing 322 through channel 380. Seal 384 aids in preventing developer mix from passing through the gap between trim bar 312 and rear surface 383 reducing the amount of developer mix entering channel 380.

In some embodiments, housing 322 also includes a foam seal 388 sandwiched between bottom surface 382 of channel 380 and the bottom of trim bar 312 and extending axially along the length of channel 380. Foam seal 388 aids in preventing developer mix from passing through channel 380 and leaking from the front 332 of housing 322 between trim bar 312 and housing 322. Foam seal 388 also aids in maintaining the desired trim bar gap 314.

In some embodiments, a seal 390 is positioned against the front 332 of base 326. Seal 390, like seal 384, is formed from a flexible material such as a polyethylene terephthalate (PET) material, e.g., MYLAR® available from DuPont Teijin Films, Chester, Va., USA. A lower segment 391 of seal 390 is adhered to front 332 of base 326 opposite front surface 381 of channel 380 along the length of channel 380. An upper segment 392 of seal 390 extends upward in a cantilevered manner above front surface 381 toward sleeve 344. Seal 390 forms an additional impediment to developer mix leaking from the front 332 of housing 322 in the area of trim bar 312 if developer unit 320 is dropped.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A developer unit for a dual component development electrophotographic image forming device, comprising:

a housing having a reservoir for storing a developer mix that includes toner and magnetic carrier beads;

a magnetic roll that includes a stationary core and a sleeve positioned around the core, the sleeve is rotatable relative to the core about an axis of rotation, the core includes at least one permanent magnet having a plurality of circumferentially spaced magnetic poles, an outer surface of the sleeve is positioned to carry developer mix attracted from the reservoir to the outer surface of the sleeve by the at least one permanent magnet in an operative rotational direction of the sleeve; and a first axial sealing rib projecting from an inner side of the housing toward the outer surface of the sleeve, the first axial sealing rib extends along an axial length of the sleeve, a distal end of the first axial sealing rib is positioned in close proximity to and spaced from the outer surface of the sleeve, the first axial sealing rib is positioned to impede the flow of developer mix in the reservoir in a direction counter to the operative rotational direction, the first axial sealing rib is positioned at a point between two of the plurality of circumferentially spaced magnetic poles where magnetic field lines of the plurality of circumferentially spaced magnetic poles have a primarily tangential orientation relative to the outer surface of the sleeve.

2. The developer unit of claim 1, wherein the first axial sealing rib extends along substantially an entire axial length of the core.

3. The developer unit of claim 1, further comprising a second axial sealing rib projecting from the inner side of the housing toward the outer surface of the sleeve, the second axial sealing rib extends along the axial length of the sleeve, a distal end of the second axial sealing rib is positioned in close proximity to and spaced from the outer surface of the sleeve, the second axial sealing rib is positioned to impede the flow of developer mix in the reservoir in the direction counter to the operative rotational direction, the second axial sealing rib is spaced circumferentially relative to the sleeve from the first axial sealing rib.

4. The developer unit of claim 3, wherein the outer surface of the sleeve is positioned to carry the developer mix from the reservoir through a portion of the magnetic roll that is exposed from the reservoir to permit transfer of toner from the outer surface of the sleeve to a photoconductive drum and back to the reservoir as the sleeve rotates in the operative rotational direction and the second axial sealing rib is positioned at an edge of the housing where developer mix reenters the reservoir after passing the portion of the magnetic roll that is exposed from the reservoir as the sleeve rotates in the operative rotational direction.

5. The developer unit of claim 3, wherein the second axial sealing rib is positioned at one of the plurality of circumferentially spaced magnetic poles.

6. The developer unit of claim 1, wherein the first axial sealing rib extends to within between 0.9 mm and 1.6 mm of the outer surface of the sleeve measured radially with respect to the axis of rotation.

7. The developer unit of claim 1, further comprising a pocket formed in the inner side of the housing positioned immediately downstream from the first axial sealing rib relative to an operative rotational direction of the sleeve, the pocket curves toward the outer surface of the sleeve counter to the operative rotational direction of the sleeve to direct developer mix traveling counter to the operative rotational direction toward the outer surface of the sleeve.

8. The developer unit of claim 1, further comprising a first circumferential sealing rib projecting from the inner side of the housing toward the outer surface of the sleeve, the first circumferential sealing rib extends circumferentially along a portion of the outer surface of the sleeve, the first circumferential sealing rib is spaced from the outer surface of the sleeve, the first circumferential sealing rib is positioned to impede the flow of developer mix in the reservoir along an axial direction of the sleeve.

9. The developer unit of claim 8, further comprising a second circumferential sealing rib projecting from the inner side of the housing toward the outer surface of the sleeve, the first circumferential sealing rib and the second circumferential sealing rib are spaced axially from each other and extend circumferentially along a common portion of the outer surface of the sleeve, the second circumferential sealing rib is spaced from the outer surface of the sleeve, the second circumferential sealing rib is positioned to impede the flow of developer mix in the reservoir along the axial direction of the sleeve.

10. The developer unit of claim 1, further comprising:

a pickup pole of the plurality of circumferentially spaced magnetic poles positioned to magnetically attract developer mix in the reservoir to the outer surface of the sleeve for carrying by the sleeve as the sleeve rotates in the operative rotational direction;

a trim bar positioned in close proximity to the outer surface of the sleeve downstream from the pickup pole relative to the operative rotational direction to trim the developer mix on the outer surface of the sleeve prior to carrying the developer mix to a portion of the magnetic roll that is exposed from the reservoir to permit transfer of toner from the outer surface of the sleeve to a photoconductive drum; and to a cantilevered flexible seal positioned against an upstream side of the trim bar relative to the operative rotational direction of the sleeve.

11. A developer unit for a dual component development electrophotographic image forming device, comprising:

a housing having a reservoir for storing a developer mix that includes toner and magnetic carrier beads;

a magnetic roll that includes a stationary core and a sleeve positioned around the core, the sleeve is rotatable relative to the core about an axis of rotation, the core includes at least one permanent magnet having a plurality of circumferentially spaced magnetic poles, the plurality of circumferentially spaced magnetic poles includes a pickup pole that is positioned to magnetically attract developer mix from the reservoir to the outer surface of the sleeve for carrying by the sleeve as the sleeve rotates in an operative rotational direction, the outer surface of the sleeve is positioned to carry the developer mix from the reservoir through a portion of the magnetic roll that is exposed from the reservoir to permit transfer of toner from the outer surface of the sleeve to a photoconductive drum and back to the reservoir as the sleeve rotates in the operative rotational direction; and a first axial sealing rib and a second axial sealing rib each projecting from an inner side of the housing toward the outer surface of the sleeve, the first axial sealing rib and the second axial sealing rib extend along an axial length of the sleeve, distal ends of the first axial sealing rib and the second axial sealing rib are positioned in close proximity to and spaced from the outer surface of the sleeve, the second axial sealing rib is spaced circumferentially relative to the sleeve from the first axial sealing rib, downstream faces of the first axial sealing rib and the second axial sealing rib relative to the operative rotational direction are angled toward the outer surface of the sleeve to direct developer mix traveling counter to the operative rotational direction toward the outer surface of the sleeve, the first axial sealing rib and the second axial sealing rib are positioned upstream from the pickup pole and downstream from the portion of the magnetic roll that is exposed from the reservoir relative to the operative rotational direction.

12. The developer unit of claim 11, wherein the first axial sealing rib is positioned at a point between two of the plurality of circumferentially spaced magnetic poles where magnetic field lines of the plurality of circumferentially spaced magnetic poles have a primarily tangential orientation relative to the outer surface of the sleeve.

13. The developer unit of claim 12, wherein the second axial sealing rib is positioned at an edge of the housing where developer mix reenters the reservoir after passing the portion of the magnetic roll that is exposed from the reservoir as the sleeve rotates in the operative rotational direction.

14. The developer unit of claim 12, wherein the second axial sealing rib is positioned at one of the plurality of circumferentially spaced magnetic poles.

15. The developer unit of claim 11, wherein the first axial sealing rib and the second axial sealing rib extend along substantially an entire axial length of the core.

16. The developer unit of claim 11, further comprising a first pocket formed in the inner side of the housing positioned immediately downstream from the first axial sealing rib relative to the operative rotational direction of the sleeve and a second pocket formed in the inner side of the housing positioned immediately downstream from the second axial sealing rib relative to the operative rotational direction of the sleeve, the first pocket and the second pocket curve toward the outer surface of the sleeve counter to the operative rotational direction of the sleeve to direct developer mix traveling counter to the operative rotational direction toward the outer surface of the sleeve.

17. The developer unit of claim 11, further comprising a first circumferential sealing rib projecting from the inner side of the housing toward the outer surface of the sleeve, the first circumferential sealing rib extends circumferentially along a portion of the outer surface of the sleeve, the first circumferential sealing rib is spaced from the outer surface of the sleeve, the first circumferential sealing rib is positioned to impede the flow of developer mix in the reservoir along an axial direction of the sleeve.

18. The developer unit of claim 17, further comprising a second circumferential sealing rib projecting from the inner side of the housing toward the outer surface of the sleeve, the first circumferential sealing rib and the second circumferential sealing rib are spaced axially from each other and extend circumferentially along a common portion of the outer surface of the sleeve, the second circumferential sealing rib is spaced from the outer surface of the sleeve, the second circumferential sealing rib is positioned to impede the flow of developer mix in the reservoir along the axial direction of the sleeve.

19. The developer unit of claim 11, further comprising:

a trim bar positioned in close proximity to the outer surface of the sleeve downstream from the pickup pole relative to the operative rotational direction to trim the developer mix on the outer surface of the sleeve prior to carrying the developer mix to the portion of the magnetic roll that is exposed from the reservoir; and a cantilevered flexible seal positioned against an upstream side of the trim bar relative to the operative rotational direction of the sleeve.

* * * * *